US007707860B2

(12) United States Patent
Hong et al.

(10) Patent No.: US 7,707,860 B2
(45) Date of Patent: May 4, 2010

(54) WASHING MACHINE COMBINED WITH DRYER

(75) Inventors: Sog Kie Hong, Seoul (KR); In Chul Jeong, Seoul (KR)

(73) Assignee: LG Electronics Inc., Seoul (KR)

( * ) Notice: Subject to any disclaimer, the term of this patent is extended or adjusted under 35 U.S.C. 154(b) by 1116 days.

(21) Appl. No.: 11/184,383

(22) Filed: Jul. 18, 2005

(65) Prior Publication Data

US 2006/0123853 A1 Jun. 15, 2006

(30) Foreign Application Priority Data

Dec. 10, 2004 (KR) ..... 10-2004-0104077

(51) Int. Cl.
*D06F 29/00* (2006.01)

(52) U.S. Cl. ..... 68/19; 68/3 R; 68/19.1; 68/20

(58) Field of Classification Search ..... None
See application file for complete search history.

(56) References Cited

U.S. PATENT DOCUMENTS

| | | | | |
|---|---|---|---|---|
| 3,139,633 A | | 7/1964 | Fecho et al. | |
| 4,821,537 A | * | 4/1989 | Zinkann et al. | 68/208 |
| 7,412,853 B2 | * | 8/2008 | Hong et al. | 68/19.1 |
| 2006/0075577 A1 | * | 4/2006 | Jeong et al. | 8/158 |
| 2006/0096335 A1 | * | 5/2006 | Park et al. | 68/20 |

FOREIGN PATENT DOCUMENTS

| | | | |
|---|---|---|---|
| DE | 4331396 C1 | * | 4/1995 |
| EP | 1380683 | | 1/2004 |
| JP | 62022693 A | * | 1/1987 |
| JP | 04109997 A | * | 4/1992 |
| JP | 2003-275497 | | 9/2003 |
| JP | 2003275497 A | * | 9/2003 |
| JP | 2004-261324 | | 9/2004 |

* cited by examiner

*Primary Examiner*—Michael Kornakov
*Assistant Examiner*—Eric Golightly
(74) *Attorney, Agent, or Firm*—Lee, Hong, Degerman, Kang & Waimey

(57) ABSTRACT

There is provided a washing machine combined with a dryer. In the washing machine, a tub is provided, a lint collector is connected to the tub to collect lint, an air-vent pipe is connected to the lint collector, a dryer duct is connected to the tub and it is provided with a blower fan therein, and a water drain line is provided to discharge water from the tub to an outside of the washing machine.

17 Claims, 8 Drawing Sheets

WASHING MACHINE COMBINED WITH DRYER

BACKGROUND OF THE INVENTION

1. Field of the Invention

The present invention relates to a washing machine combined with a dryer, and more particularly, to a washing machine combined with a dryer that has a lint collector to remove lint from moist air discharged from a tub.

2. Description of the Related Art

A washing machine is a home appliance for washing clothes automatically. A typical washing machine uses an electric motor as a driving unit to agitate clothes together with water containing detergent to remove dirt from the clothes. The washing process of the washing machine generally includes washing, rinsing, spin-drying, and/or heat-drying operations.

Washing machines can be classified into a drum type washing machine, an agitator type washing machine, and a pulsator type washing machine.

The drum type washing machine includes a plurality of lifters inside of a drum to lift up and drop down clothes in the drum as the drum is rotated about a horizontal axis at a low speed. Therefore, the clothes can be cleaned by the collision with water containing detergent.

Meanwhile, a washing machine combined with a dryer is recently introduced to satisfy user's demand. In this washing machine, clothes are heat dried after washed, rinsed, and spin dried.

The washing machine combined with the dryer can be classified into a condenser type and a vented type depending on a drying method.

The washing machine combined with the condenser type dryer removes residual moisture from clothes by circulating air through a drum, a heat exchanger, and a heater without discharging the air out of the washing machine until the heat drying operation is completed. That is, the air becomes moist after passing through the drum, the moist air cools down at the heat exchanger by exchanging heat with a cooling water, the moisture in the air condenses and drops down to the bottom of the tub as the moist air cools down, and the air is heated again by the heater and then enters the drum again.

In the washing machine combined with the vented type dryer, on the contrary, a heated dry air is blew into a drum to take moisture from clothes and then the air containing lots of moisture is discharged out of the washing machine through a connecting pipe connected between a tub and a vent duct.

However, the moist air, which is discharged from the washing machine combined with the vented type dryer, contains lint such as fluff, thereby contaminating the indoor air.

Further, the lint in the moist air, though it is light, falls down and builds up while it is discharged from the tub to the outside through the vent duct. Particularly, the lint builds up on a pleated surface of the connecting pipe connected between the tub and the vent duct. The build-up of the lint becomes bigger according to the time of use, blocking the vent duct. Further, the build-up of the lint increases the possibility of fire. Therefore, there is an increasing need for a structure that can remove the problems related to the lint.

SUMMARY OF THE INVENTION

Accordingly, the present invention is directed to a washing machine combined with a dryer that substantially obviates one or more problems due to limitations and disadvantages of the related art.

An object of the present invention is to provide a washing machine combined with a vented type dryer, in which an air-vent line, including an air-vent duct and an air-vent pipe connected between a tub and the air-vent duct, is prevented from being plugged by lint generated during a heat drying operation.

Another object of the present invention is to provide a washing machine combined with a dryer, in which lint generated during a heat drying operation is prevented from building up in an air-vent line and therefore the possibility of fire reduces.

A further another object of the present invention is to provide a washing machine combined with a dryer, in which lint is separated and collected from a moist air discharged from a tub and then the air is discharged to an outside of the washing machine without lint.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a washing machine combined with a dryer, including: a tub; a lint collector connected to the tub to collect lint; an air-vent pipe connected to the lint collector; a dryer duct connected to the tub and provided with a blower fan therein; and a water drain line to discharge water from the tub to an outside of the washing machine.

In another aspect of the present invention, there is provided a washing machine combined with a dryer, including: a tub; a lint collector connected to the tub, the lint collector including a separation hopper in which a moist air introduced from the tub is rotated by a cyclone effect, a lint chamber connected to a bottom of the separation hopper, and a floater installed in the lint chamber to selectively open and close the connection between the separation hopper and the lint chamber; an air-vent pipe connected to the lint collector to discharge the moist air from the lint collector; a water drain line having one end connected to the tub and the other end connected to the lint collector; and a blowing unit blowing a heated air into the tub.

In a further another aspect of the present invention, there is provided a washing machine combined with a dryer, including: a tub; a cyclone lint collector receiving a moist air from the tub; and a water drain line connected to the cyclone lint collector, wherein the moist air whirls in the cyclone lint collector to separate lint therefrom, the separated lint being discharged through the water drain line together with water passing therethrough.

According to the present invention, the lint is separated from the moist air discharged from the tub, and the separated lint is collected to the separate lint collector and then it is discharged together with the draining water. Therefore, the moist air can be discharged to an outside of the washing machine without lint.

Further, since the collected lint is discharged together with the draining water, an additional filter or lint bag is not required to collect and remove the lint.

Further, since the collected lint is discharged together with the draining water, it is not required for the user to take action to remove the collected lint.

Further, since the separated lint is collected to the separate lint collector and then it is discharged together with the draining water, the lint does not build up in the washing machine and therefore the possibility of fire in the washing machine is reduced.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
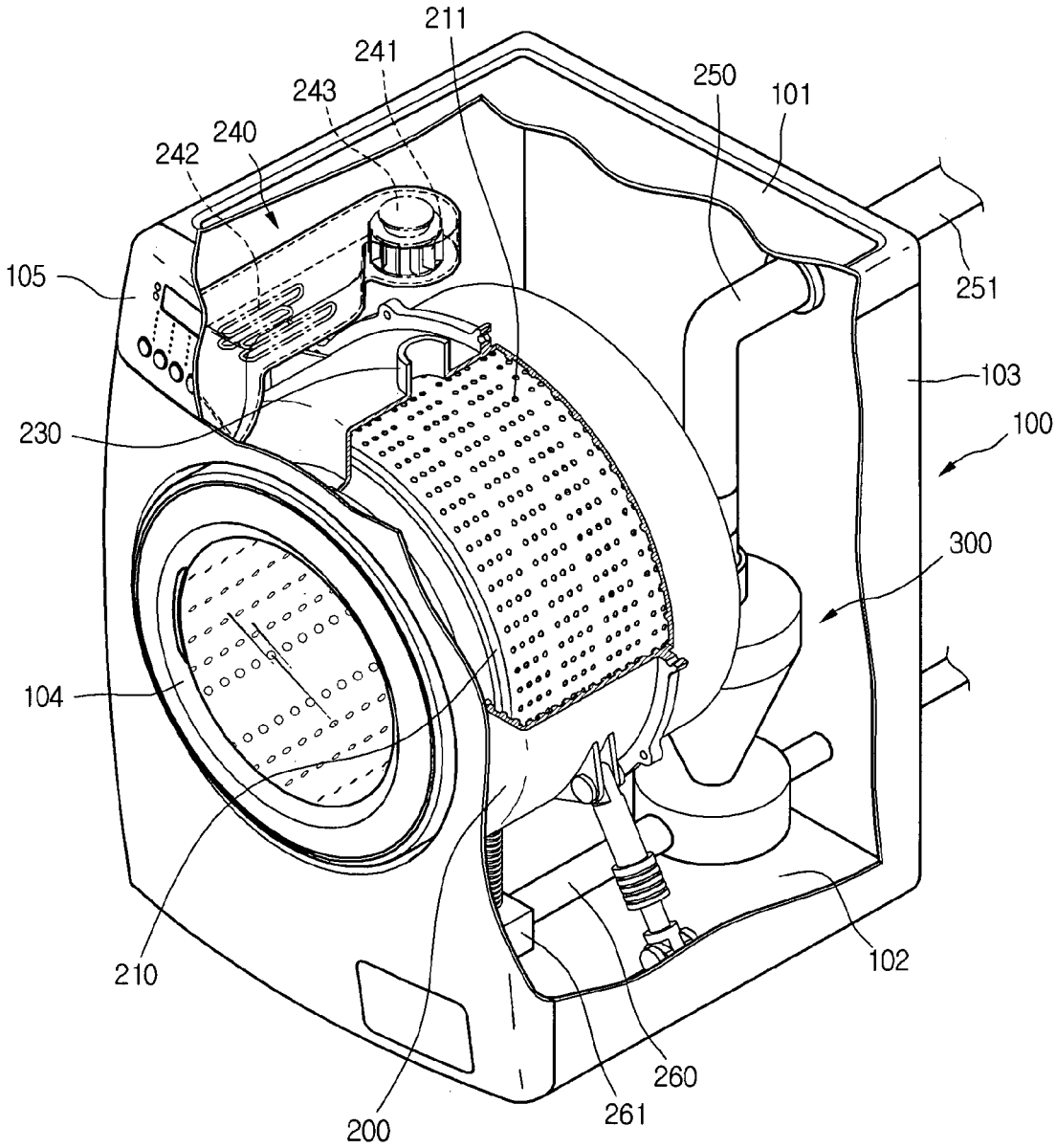
FIG. 1 is a perspective view of a washing machine combined with a dryer, in which a lint collector is provided according to the present invention.
Figure 2:
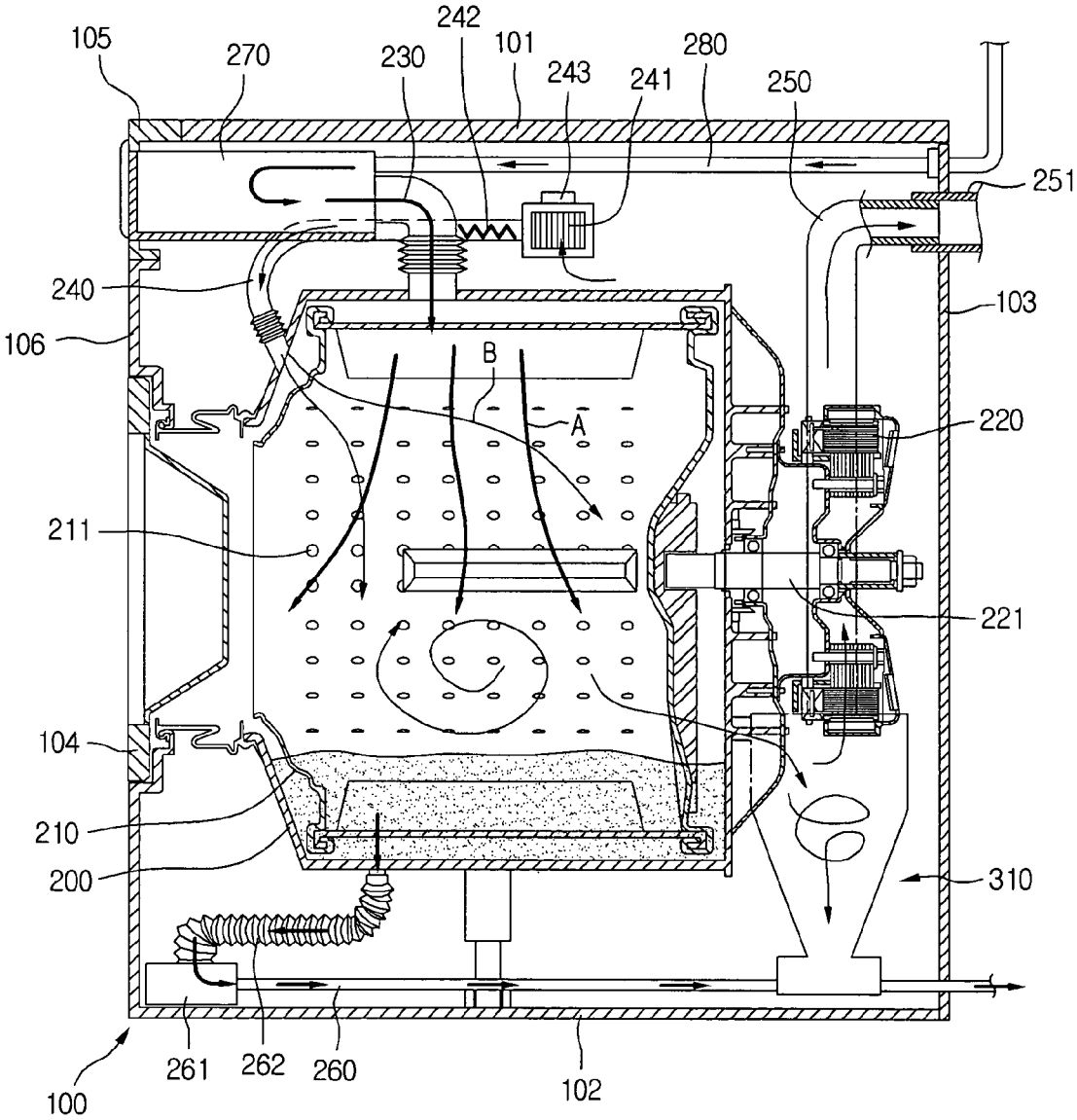
FIG. 2 is a side sectional view of the washing machine combined with the dryer depicted in FIG. 1.

FIG. 1 is a perspective view of a washing machine combined with a dryer, in which a lint collector is provided according to the present invention, and FIG. 2 is a side sectional view of the washing machine combined with the dryer depicted in FIG. 1.

Referring to FIGS. 1 and 2, a washing machine combined with a dryer 100 includes: an enclosing cabinet 103; a top plate 101 mounted on a top of the cabinet 103; a base plate 102 installed on a bottom of the cabinet 103; a front cover 106 mounted on a front of the cabinet 103; a door 104 rotatably installed at a center of the front cover 106; a control panel 105 installed at an upper portion of the front cover 106, the control panel 105 having a plurality of input buttons and a display; a detergent dispenser drawer 270 inserted into a side of the control panel 105 to receive detergent or fabric softener; a water inlet hose 280 to supply water to the detergent dispenser drawer 270; and a bellows 230 connecting the detergent dispenser drawer 270 and a tub 200 to introduce a mixture of the water and the detergent into the tub 200.

Further, the washing machine combined with the dryer 100 includes the tub installed in the cabinet 103 to receive the water (or the mixture of the water and the detergent), a drum 210 installed in the tub 200 to receive clothes, and a driving motor 220 mounted on a back of the tub 200 to rotate the drum 210. The driving motor includes a shaft connected to a rear of the drum 210.

Further, the washing machine combined with the dryer 100 includes a blowing unit such as a dryer duct 240 installed between the cabinet 103 and a top of the tub 200 to introduce a surrounding air into the tub 200, a lint collector 300 installed between the tub 200 and the cabinet 103 and connected to a rear of the tub 200 to discharge moist air therethrough from the drum 210 to the outside, an air-vent pipe 250 connected to an end of the lint collector 300 to discharge the moist air after lint is removed from the moist air at the lint collector 300, and an air-vent duct 251 installed through the cabinet 103 and connected with the air-vent pipe 250. The lint collector 300 may be a cyclone lint collector.

The dryer duct 240 includes a blower fan 241 installed therein to draw in the surrounding air, a fan motor 243 to drive the dryer fan 241, a heater 242 to apply heat to the air drawn in by the dryer fan 241. The fan motor 243 is mounted on the dryer duct 240 to drive the dryer fan 241.

Further, the washing machine combined with the dryer 100 includes a drain tube 262 of which one end is connected to a bottom of the tub 200 to discharge the water contaminated during a washing operation or a rinsing operation, a drain pump 261 connected to the other end of the drain tube 262 to pump out the contaminated water, and a water drain line 260 to discharge the contaminated water pumped by the drain pump 261 to the outside.

The water drain line 260 is connected to the lint collector 300 to receive lint collected from the lint collector 300 during a heat drying operation and discharge the received lint together with the contaminated water. The water drain line 260 is further extended from the lint collector 300 to the outside through the cabinet 103.

An operation of the washing machine combined with the dryer 100 will now be described.

Reference character "A" in FIG. 2 denotes the flow passage of washing water during a washing operation or a rinsing operation, and reference character "B" in FIG. 2 denotes the flow passage of air during a heat drying operation.

First, a user opens the door 210, loads clothes in the drum 210 through the opened door 210, and closes the door 210. Next, the user pulls out the detergent dispenser drawer to fill it with detergent and fabric softener. Then, the user selects operating conditions using the control panel 105 and presses a start button on the control panel 105.

Upon the pressing of the start button of the control panel 105, water is supplied to the detergent dispenser drawer 270 through the water inlet hose 280. The water mixed with the detergent (washing water) enters the tub 200 through the bellows 230 connected between the detergent dispenser drawer 270 and the tub 200. The water is supplied until the tub 200 is filled with the water to a predetermined level. After the water is filled, the driving motor 220 drives the drum 210 to carry out a washing operation.

During the washing operation, the clothes and the washing water is lifted up by the rotation of the drum 210 and then dropped down. By these up and down motions and the detergent, the dirt can be removed from the clothes during the washing operation.

After The washing operation is carried out for a set time, the washing water contaminated is discharged and fresh water is supplied to the tub 200 to carry out a rinsing operation. When the contaminated water is discharged, the driving motor 220 is stopped and the drain pump 261 is operated to drain the contaminated water from the tub 200 through the drain tube 262. The contaminated water is dumped by the drain pump 261 toward the lint collector 300 along the water drain line 260. At the lint collector 300, the contaminated water wipes collected lint off the lint collector and then further flows along the water drain line 260 to the outside. Then, the fresh water (rinsing water) is supplied to the tub 200 for the rinsing operation. After the rinsing operation, the rinsing water is discharged to the outside in the same manner as the washing operation. That is, the rinsing water also removes the collected lint from the lint collector 300 before it is discharged to the outside.

Further, a spin drying operation is carried out after the rinsing operation to remove residual water from the clothes, and then a heat drying operation is optionally carried out. The water spun out from the clothes during the spin drying operation is also directed to the lint collector 300 before it is discharged to the outside.

In the heat drying operation, the blower fan 241 installed in the dryer duct 240 is driven to draw in a surrounding air from between the cabinet 103 and the tub 200. The heater 242 applies heat to the drawn-in air, and the heated air is directed into the tub 200 along the dryer duct 240. The heated air flows from the tub 200 into the drum 210 through a plurality of holes defined in the drum 210. The heated air, having a low humidity, takes moisture from the clothes and therefore it becomes a moist air. The moist air is directed to the lint collector 300 from the tub 200. In the lint collector 300, the moist air rotates along the inner surface of the lint collector 300 and the lint is separated from the moist air by the cyclone effect. The separated lint falls down to the bottom of the lint collector 300 and the moist air is discharged from the lint collector 300 to the outside through the air-vent pipe and the air-vent duct. The moist air circulation and lint separation in the lint collector 300 will be more fully described with reference to the accompanying drawings.

Figure 3:
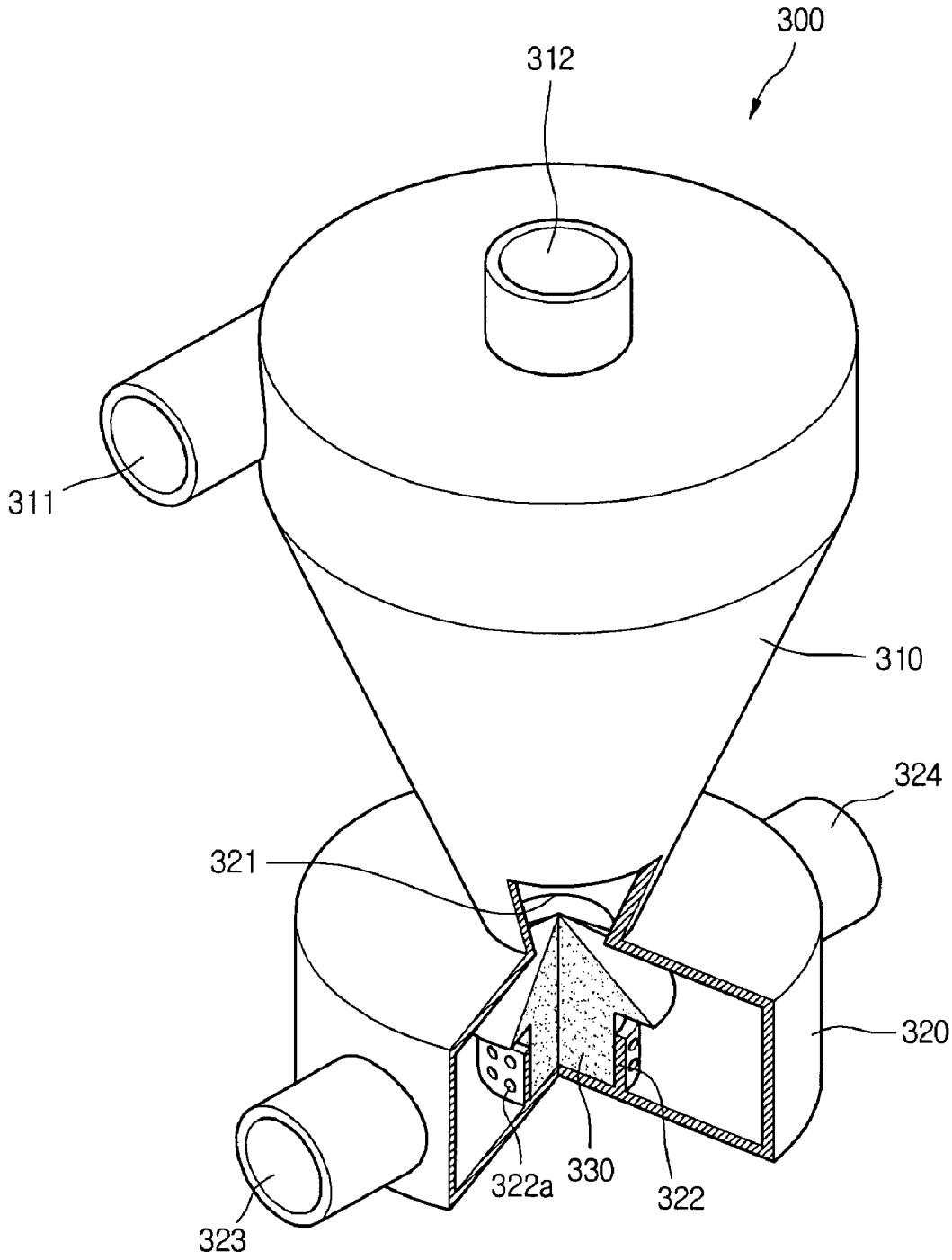
FIG. 3 is a cut-away view of a lint collector according to a first embodiment of the present invention.

FIG. 3 is a cut-away view of a lint collector according to a first embodiment of the present invention.

Referring to FIG. 3, the lint collector 300 includes a separation hopper 310 and a lint chamber 320. The separation hopper 310 receives the moist air from the tub 200 to separate the lint from the moist air, and the lint chamber 320 is connected to a bottom of the separation hopper 310 to collect the separated lint. The separation hopper 310 may function as a vortex generating portion.

The separation hopper 310 includes an extended air inlet 311 at an upper side for connection with the tub 200 and an air outlet 312 formed at a top for connection with the air-vent pipe 250. The separation hopper 310 is shaped like a funnel with a downwardly tapered shape. The air inlet 311 is extended from the separation hopper 310 in a tangential direction.

The lint chamber 320 includes a water inlet 323 and a water outlet 324. The water inlet 323 is formed in a radial direction of the lint chamber 320 and connected to the water drain line 260 to receive water pumped by the drain pump 261. The water outlet 324 is formed in the opposite direction to the water inlet 323 to discharge the water from the lint collector 300 after the water wipes out the collected lint. A connecting hole is defined between the lint chamber 320 and the separation hopper 310 with a predetermined diameter, and a valve such as a floater 330 is installed in the lint chamber 320 to selectively open and close the connecting hole 330. Also, a guide 322 is formed at an inner bottom of the lint chamber 320 to support the floater 330. The floater 330 is inserted in the guide 322 and it is capable of moving up and down therein. The guide 322 defines a plurality of holes 322*a* to allow water flow therethrough. That is, when water is introduced to the lint chamber 320, the water flows into the guide 322 through the holes 322*a* to float the floater 330.

The floater 330 is made of light material to float on the water, such that when the contaminated washing water flows through the lint chamber 320 the floater 330 is raised up by the buoyant force of the contaminated washing water. The upper portion of the floater 330 is shape like a cone with an upwardly decreasing cross section, such that the floater 330 can easily close the connecting hole 321 when it is raised up by the buoyant force of the washing water.

Operations of the lint collector 300 will now be fully described with reference to the accompanying drawings according to the heat drying operation and other operations of the washing machine combined with the dryer 100.

Figure 4:
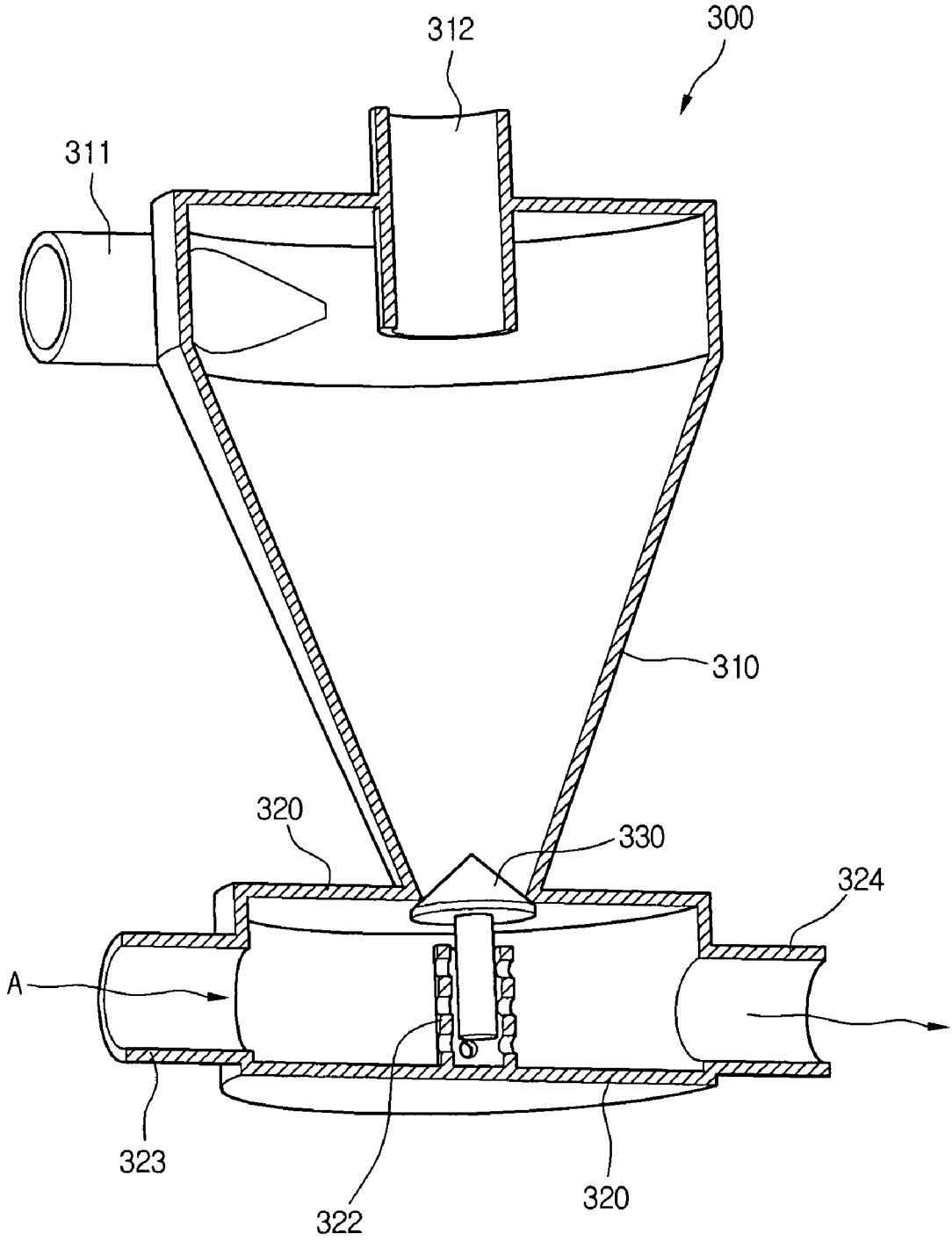
FIG. 4 is a cut-away view showing an operation of a lint collector when a heat drying is not carried out according to the present invention.

FIG. 4 is a cut-away view showing an operation of a lint collector when a heat drying operation is not carried out according to the present invention.

Here, other operations except the heat drying operation may be washing, rinsing, and spin drying operations of the washing machine combined with the dryer 100.

Referring to FIG. 4, water flows through the lint collector 300 when the heat drying operation is not carried out.

In detail, when water is drained from the tub 200 after the washing operation, the rinsing operation, or the spin drying operation. The drained water is pumped by the drain pump 261 toward the lint chamber 320 through the water drain line 260 and the water inlet 323 of the lint chamber 320. The water introduced into the lint chamber 320 raises the floater 330 to close the connecting hole 321. Therefore, the water is prevented from reversely flowing into the separation hopper 310.

The introduced water as it flows through the lint chamber 320 removes collected lint from the lint chamber 320 and then it is discharged through the water outlet 324 together with the removed lint.

Figure 5:
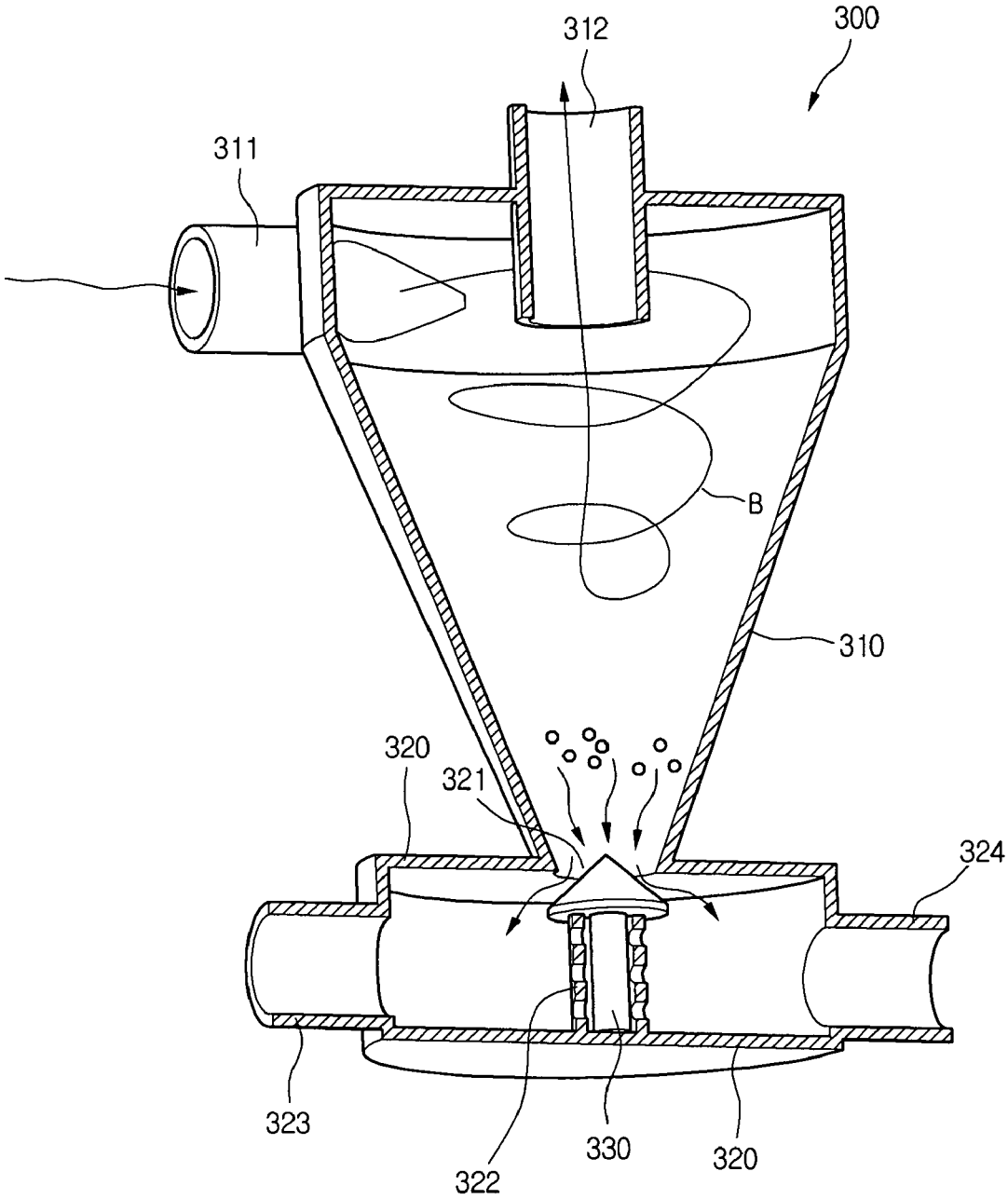
FIG. 5 is a cut-away view showing an operation of a lint collector when a heat drying is carried out according to the present invention.

FIG. 5 is a cut-away view showing an operation of a lint collector when a heat drying is carried out according to the present invention.

Referring to FIG. 5, in the heat drying operation of the washing machine combined with the dryer 100, a heated air is introduced into the tub 200 through the dryer duct 240. In the tub 200, the heated air becomes moist by taking moisture from the clothes to dry the clothes, and lint departed from the clothes floats in the air. The moist air is then directed to the separation hopper 310 through the air inlet 311 of the lint collector 300 that is connected to the rear of the tub 200. In the separation hopper 310, the moist air is rotated down along the wall of the separation hopper 310, and the lint is separated from the rotating moist air by the cyclone effect. The separated lint falls down to the lint chamber 320, and the moist air is raised upwardly and discharged to the outside through the air outlet 312, the air-vent pipe 250, and the air-vent duct 251.

Figure 6:
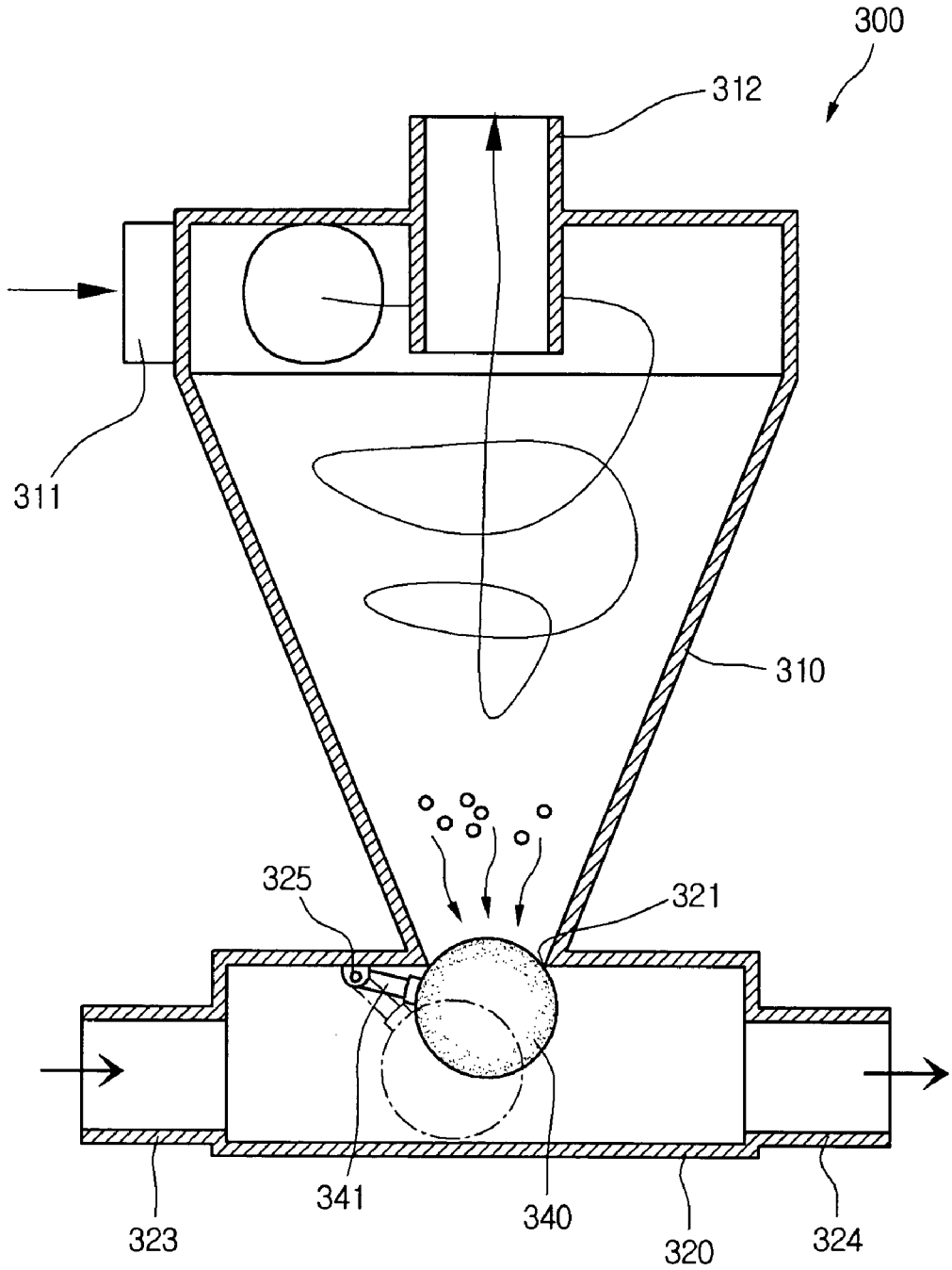
FIG. 6 is a side sectional view of a lint collector according to a second embodiment of the present invention.

FIG. 6 is a side sectional view of a lint collector according to a second embodiment of the present invention.

Referring to FIG. 6, a lint collector 300 is characterized by a valve such as a rotatable floater 340 according to a second embodiment of the present invention.

In detail, to selectively open and close the connecting hole 321, the lint collector 300 includes the spherical floater 340, an arm 341 extended from the floater 340 with a predetermine length, and a hinge 325 to which a free end of the arm 341 is hinged.

The floater 340 may be hollow or have a specific gravity lighter than the water. Therefore, the floater 340 floats up to close the connecting hole 321 when water is introduced into the lint chamber 320, and it rotates down to open the connecting hole 321 when there is no water in the lint chamber 320 during the heat drying operation. During the heat drying operation, lint falls down from the separation hopper 310 and collected in the lint chamber 320 through the opened connecting hole 321.

Figure 7:
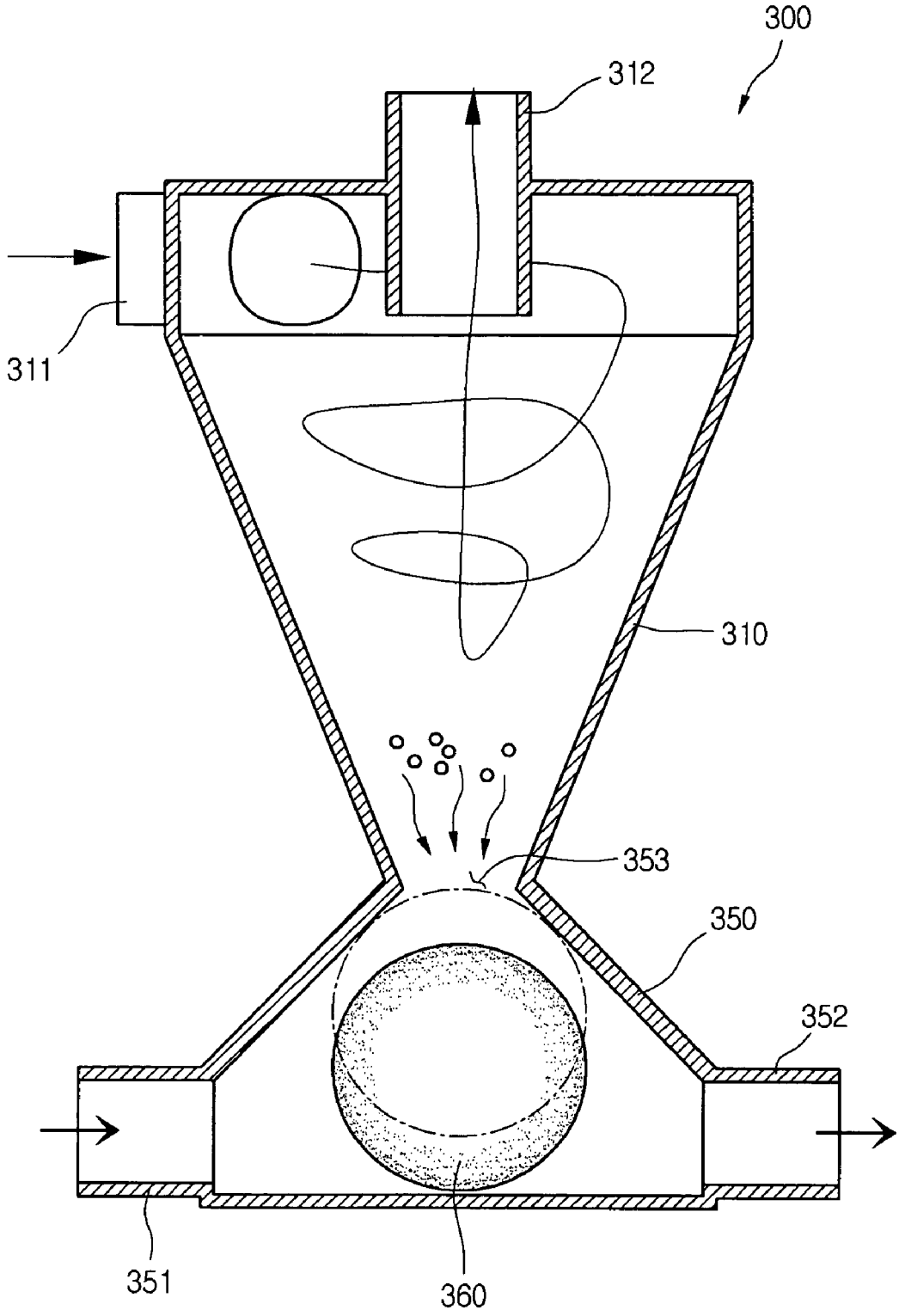
FIG. 7 is a side sectional view of a lint collector according to a third embodiment of the present invention.

FIG. 7 is a side sectional view of a lint collector according to a third embodiment of the present invention.

Referring to FIG. 7, a lint collector 300 includes a lint chamber 350, a water inlet 351 formed at one side of the lint chamber 350, a water outlet 352 formed the other side of the lint chamber 350, and a connecting hole 353 defined between a top of the lint chamber 350 and the separation hopper 310.

The lint chamber 350 has a downwardly widening shape and accommodates a valve such as a spherical floater 360 having a predetermine diameter. The floater 360 may be made of the same material as the floaters of the first and the second embodiments of the present invention. During the heat drying operation of the washing machine combined with the dryer 100, the floater 360 rests on an inner bottom of the lint chamber 350 to open the connecting hole 353. During other operations of the washing machine 100, namely, when water is introduced into the lint chamber 350, the floater 360 floats up to close the connecting hole 353.

Figure 8:
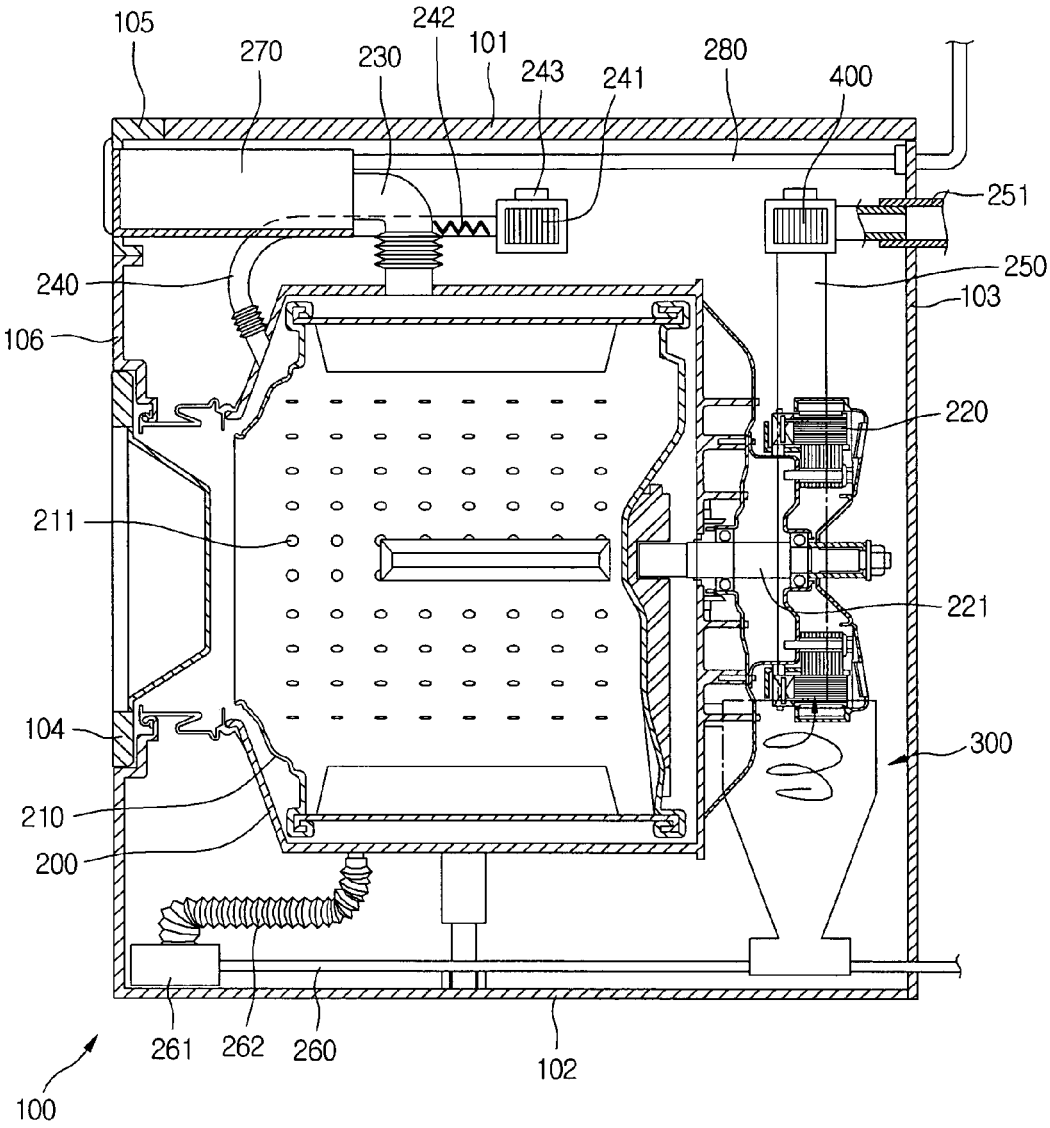
FIG. 8 shows another embodiment of a washing machine combined with a dryer according to the present invention, in which a lint collector is provided.

FIG. 8 shows another embodiment of a washing machine combined with a dryer according to the present invention, in which a lint collector is provided.

Referring to FIG. 8, a washing machine combined with a dryer 100 is characterized by a vent fan 400 installed in the air-vent pipe 250.

The washing machine combined with the dryer 100 depicted in FIG. 8 is the same structure as is depicted in FIGS. 1 and 2, excepting the vent fan 400 installed in the air-vent pipe 250 between the lint collector 300 and the air-vent duct 251. The vent fan 400 is provided to forcibly discharge moist air to the outside.

In detail, moist air is introduced into the separation hopper 310 from the tub 200, and the moist air is rotated along the inner wall of the separation hopper 310 to separate lint from the moist air by the cyclone effect. Then, the moist air is directed to the air-vent pipe 250 and it can be more rapidly discharged to the outside through the air-vent duct 251 owing to the vent fan 400 installed in the air-vent pipe 250.

Meanwhile, a magnet valve such as a solenoid valve may be used instead of the floater to selectively open and close the connecting hole defined between the separation hopper and the lint chamber.

That is, the opening and closing of the connecting hole can be automatically and exactly carried out according to the heat drying operation and other operations without error.

It will be apparent to those skilled in the art that various modifications and variations can be made in the present invention. Thus, it is intended that the present invention covers the modifications and variations of this invention provided they come within the scope of the appended claims and their equivalents.

The invention claimed is:

1. A washing machine combined with a dryer, comprising:

a tub;

a lint collector connected to the tub to collect lint, wherein the lint collector includes a separation hopper to separate the lint from moist air and a lint chamber connected to the separation hopper to collect the separated lint, the lint chamber having a water inlet to receive water from the tub and a water outlet to discharge the water from the lint collector;

an air-vent pipe connected to the lint collector;

a dryer duct connected to the tub and provided with a blower fan therein;

a water drain line to guide the discharged water from the tub to an outside of the washing machine, wherein the water drain line is connected with the water inlet and the water outlet;

a connecting hole connecting the separation hopper to the lint chamber; and a valve installed in the lint chamber to selectively open and close the connecting hole, wherein the valve closes the connecting hole when water is received through the water inlet.

2. The washing machine according to claim 1, wherein the lint collector has a shape in which the moist air introduced from the tub is whirled by a cyclone effect.

3. The washing machine according to claim 1, wherein the valve is floater operating by a buoyant force of water received in the water inlet.

4. The washing machine according to claim 1, wherein the lint chamber includes a guide at an inner bottom to guide the valve.

5. The washing machine according to claim 1, wherein the separation hopper has a downwardly tapered funnel shape.

6. The washing machine according to claim 1, wherein the lint chamber has a downwardly widening shape.

7. The washing machine according to claim 1, wherein the air-vent pipe includes vent fan installed therein.

8. A washing machine combined with a dryer, comprising:

a tub;

a lint collector connected to the tub, the lint collector including a separation hopper in which moist air introduced from the tub is rotated by a cyclone effect, a lint chamber connected to a bottom of the separation hopper, the separation hopper having a water inlet to receive water discharged from the tub and a water outlet to discharge the water from the lint collector, and a floater installed in the lint chamber to selectively open and close a connecting hole between the separation hopper and the lint chamber, wherein the connecting hole is closed by the floater when water is received through the water inlet;

an air-vent pipe connected to the lint collector to discharge the moist air from the lint collector;

a water drain line connected to the water inlet and further extended from the water outlet to the outside of the washing machine; and a blowing unit to blow heated air into the tub.

9. The washing machine according to claim 8, wherein the separation hopper includes:

an air outlet formed at a top and connected to the air-vent pipe; and an air inlet formed in a tangential direction of the separation hopper and connected to the tub.

10. The washing machine according to claim 8, wherein the floater has an upper conical portion to selectively open and close the connecting hole.

11. The washing machine according to claim 8, wherein the floater has a spherical shape with a predetermined diameter.

12. The washing machine according to claim 8, wherein the floater is hinged to an inner surface of the lint chamber.

13. The washing machine according to claim 8, wherein the floater is made of material having a specific gravity smaller than water.

14. The washing machine according to claim 8, wherein the floater is hollow to float on water.

15. The washing machine according to claim 8, wherein the floater opens the connecting hole when a heat drying operation is carried out and closes the connecting hole when water is discharged from the tub via the lint chamber.

16. The washing machine according to claim 8, wherein when water is discharged from the tub through the water drain line, the lint chamber receives the water from the water drain line to remove lint collected at the lint chamber and then the water is discharged together with the removed lint.

17. The washing machine according to claim 4, wherein the guide is formed with at least one hole to allow water to flow through.

* * * * *